US009724710B2

(12) United States Patent
Tokoh

(10) Patent No.: US 9,724,710 B2
(45) Date of Patent: Aug. 8, 2017

(54) FILM COATING APPARATUS

(71) Applicant: KABUSHIKI KAISHA TOSHIBA, Minato-ku (JP)

(72) Inventor: Masahiro Tokoh, Yokohama (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 14/638,426

(22) Filed: Mar. 4, 2015

(65) Prior Publication Data

US 2015/0273495 A1 Oct. 1, 2015

(30) Foreign Application Priority Data

Mar. 31, 2014 (JP) ..... 2014-074037

(51) Int. Cl.

| | |
|---|---|
| ***B05C 11/00*** | (2006.01) |
| ***B05B 5/025*** | (2006.01) |
| ***B05B 5/16*** | (2006.01) |
| ***B05B 15/04*** | (2006.01) |
| ***B05B 13/02*** | (2006.01) |

(52) U.S. Cl.

CPC ..... *B05B 5/0255* (2013.01); *B05B 5/1608* (2013.01); *B05B 13/0221* (2013.01); *B05B 15/045* (2013.01)

(58) Field of Classification Search

USPC ..... 118/620–640, 504, 505

See application file for complete search history.

(56) References Cited

U.S. PATENT DOCUMENTS 5,601,468 A * 2/1997 Fujii ..... H01J 9/2271 427/68
5,831,701 A * 11/1998 Matsuyama ..... G02F 1/133512 349/110
6,841,049 B2 1/2005 Ito et al.
2003/0150739 A1 8/2003 Morozov et al.
2013/0287964 A1* 10/2013 Radovanov ..... C23C 14/48 427/526

(Continued)

FOREIGN PATENT DOCUMENTS

CN 102713039 A 10/2012
JP 9-38529 A 2/1997

(Continued)

OTHER PUBLICATIONS

English Translation of JP 2011099178A, May 19, 2011.*

(Continued)

*Primary Examiner* — Yewebdar Tadesse
(74) *Attorney, Agent, or Firm* — Oblon, McClelland, Maier & Neustadt, L.L.P.

(57) ABSTRACT

In general, according to one embodiment, a film coating apparatus includes a discharge section configured to discharge a film formation material; a voltage application section configured to apply a voltage to the film formation material, and to set the film formation material at a high potential relative to a film formation object which is subjected to film formation; a mask disposed at a position overlapping a non-coating portion of the film formation object along a direction from the discharge section toward the non-coating portion; and a potential adjusting module configured to make a potential of the mask equal to a potential of the film formation object.

2 Claims, 2 Drawing Sheets

(56) References Cited

U.S. PATENT DOCUMENTS

2014/0302244 A1* 10/2014 Ling ..... H05B 33/14
427/468

FOREIGN PATENT DOCUMENTS

| | | | |
|---|---|---|---|
| JP | 2001-212479 | A | 8/2001 |
| JP | 2007-229851 | A | 9/2007 |
| JP | 2010-121221 | A | 6/2010 |
| JP | 2011-099178 | A | 5/2011 |
| JP | 2015-150470 | A | 8/2015 |

OTHER PUBLICATIONS

Office Action issued on Apr. 26, 2016 in Korean Patent Application No. 10-2015-0025594 (with English language translation).
Combined Chinese Office Action and Search Report issued Sep. 5, 2016 in Patent Application No. 201510097406.0 (with English language translation).
Office Action issued on Oct. 21, 2016 in Korean Patent Application No. 10-2015-0025594 (with English translation).
Notice of Allowance issued on Dec. 21, 2016 in Korean Patent Application No. 10-2015-0025594.
Office Action issued Aug. 23, 2016 in Japanese Patent Application No. 2014-074037 (with English language translation).

* cited by examiner

FILM COATING APPARATUS

CROSS-REFERENCE TO RELATED APPLICATION

This application is based upon and claims the benefit of priority from Japanese Patent Application No. 2014-074037, filed Mar. 31, 2014; the entire contents of which are incorporated herein by reference.

FIELD

Embodiments described herein relate generally to a film coating apparatus for coating a film of a film formation material on a film formation object which is subjected to film formation, for example, by using an electrospinning method.

BACKGROUND

There has been proposed an apparatus for coating a film of a film formation material, such as nanofibers, on a film formation object such as a sheet, which is subjected to film formation, by using an electrospinning method. In this kind of apparatus, a technique has been proposed for adjusting a deposition area on the film formation object, on which a film of nanofibers is to be formed.

DETAILED DESCRIPTION

In general, according to one embodiment, a film coating apparatus includes a discharge section configured to discharge a film formation material; a voltage application section configured to apply a voltage to the film formation material, and to set the film formation material at a high potential relative to a film formation object which is subjected to film formation; a mask disposed at a position overlapping a non-coating portion of the film formation object along a direction from the discharge section toward the non-coating portion; and a potential adjusting module configured to make a potential of the mask equal to a potential of the film formation object.

Figure 1:
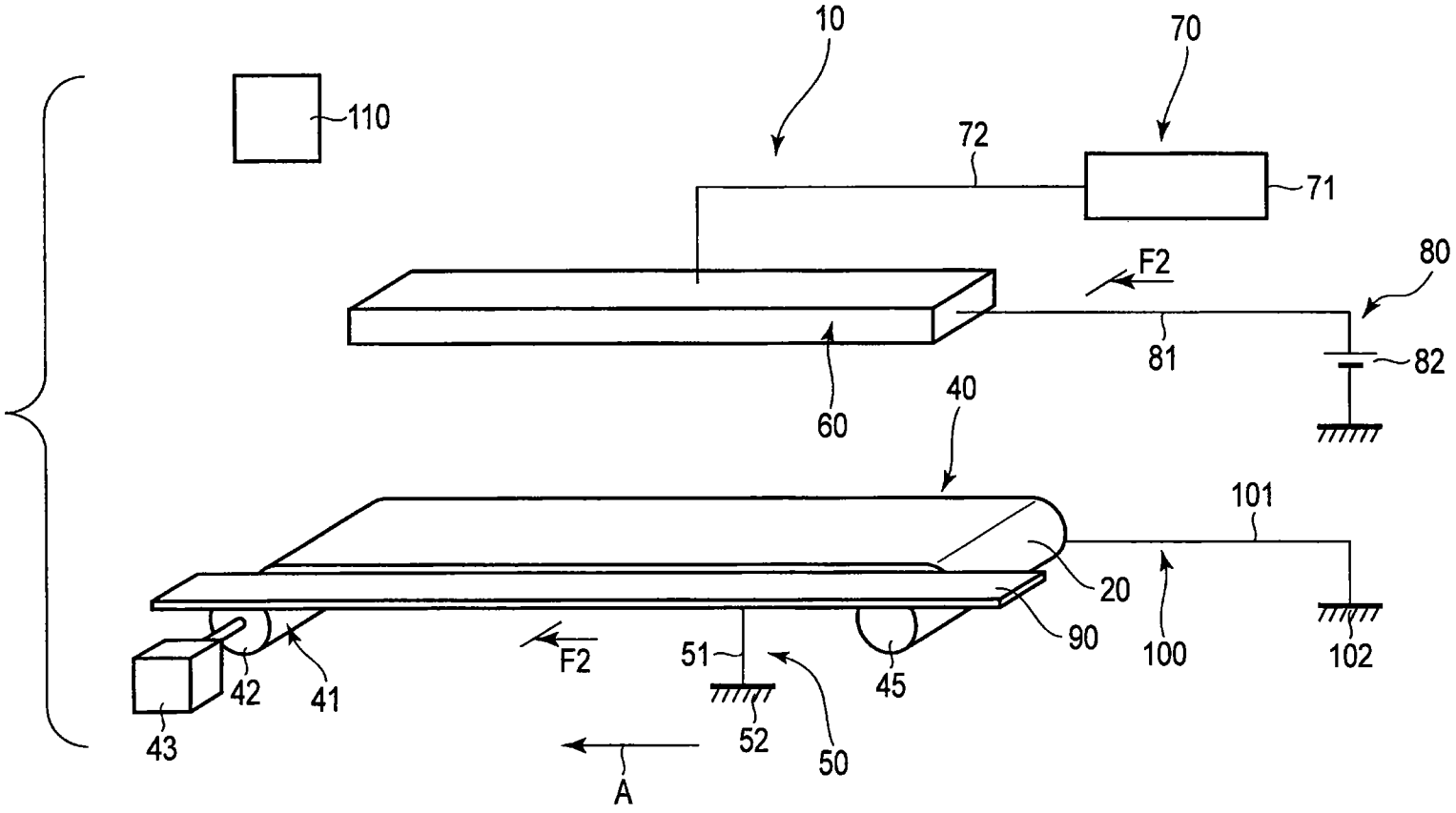
FIG. 1 is a perspective view illustrating a film coating apparatus according to a first embodiment.

A film coating apparatus according to a first embodiment will now be described with reference to FIG. 1 and FIG. 2. This film coating apparatus is an example of the film coating apparatus. FIG. 1 is a perspective view illustrating a film coating apparatus 10. As illustrated in FIG. 1, the film coating apparatus 10 is an apparatus which forms a film of a separator 30 on an electrode 20 of a battery, which is an example of a film formation object that is subjected to film formation, by coating a liquid L, which is an example of a film formation material, on the electrode 20, by using, for example, an electrospinning method. The electrode 20 has a sheet shape and is elongated in one direction.

The film coating apparatus 10 includes a convey device 40 which feeds the electrode 20 along a convey direction A; an electrode grounding module (a potential adjusting module, a film formation object grounding module) 50 which grounds the electrode 20; a discharge device (a discharge section) 60 which discharges toward the electrode 20 the liquid L for forming nanofibers; a liquid supply device 70 which supplies the liquid L to the discharge device 60; a voltage application device (a voltage application section) 80 which applies a voltage to the liquid L that is supplied to the discharge device 60; a mask 90 for performing selective coating on the electrode 20; a mask grounding module (a potential adjusting module, a voltage increase prevention module) 100; and a control device 110 which controls the operation of the film coating apparatus 10.

The convey device 40 includes a take-up roller device 41 which takes up the electrode 20, and a driven roller 45 which is rotatably provided. The take-up roller device 41 includes a take-up roller 42 configured to be rotatable, and a roller driving device 43 which rotates the take-up roller 42.

The take-up roller 42 and driven roller 45 are disposed spaced apart, in such an attitude that their axes are parallel to each other. A direction from the driven roller 45 toward the take-up roller 42 is the convey direction A. One end in the convey direction A of the electrode 20 is fixed to the take-up roller 42. The other end in the convey direction A of the electrode 20 is fixed to the driven roller 45. The electrode 20 is wound around the driven roller 45.

The electrode grounding module 50 includes a wiring line 51 which is formed to be electrically connectable to the electrode 20 disposed on the rollers 42 and 45, and a base portion 52 connected to the wiring line 51. A part of the base portion 52 is, for example, buried in the earth, and is configured to be able to keep the potential of the electrode 20 at zero.

In the present embodiment, for example, the wiring line 51 is connected to the driven roller 45. The driven roller 45 is formed to be able to transmit a charge, with which the electrode 20 is electrified, to the wiring line 51. The base portion 52 is provided at a position apart from the convey device 40. The wiring line 51 is formed to be able to transmit the charge of the electrode 20 to the base portion 52.

The discharge device 60 is configured to be able to discharge the liquid L which is the material for forming the separator 30.

The liquid supply device 70 includes a liquid supply source 71 including a tank for storing the liquid L and a pump for supplying the liquid L from the tank, and a liquid supply pipe 72 which is formed to be able to supply the liquid in the liquid supply source 71 to the discharge device 60. The liquid supply pipe 72 is coupled to the discharge device 60.

The voltage application device 80 includes a wiring line 81 which is electrically connected to the discharge device 60, and a power supply device 82 which applies a voltage to the wiring line 81.

The potential of the electrode 20 is set at zero by the electrode grounding module 50. Thereby, the liquid L, which is discharged from the discharge device 60, is guided to the electrode 20 by a Coulomb force occurring due to a potential difference between the voltage, which is applied to the liquid L, and the electrode 20. During the time before the liquid L reaches the electrode 20, the liquid L becomes nanofibers N and the nanofibers N are coated on the electrode 20.

By the coated nanofibers N, a film is formed on the electrode 20. The formed film has a shape of a nonwoven fabric which is formed of the nanofibers N, and the film becomes the separator 30. In this manner, by the electrospinning method, the film of the separator 30 is formed on the electrode 20.

Next, the electrode 20 is concretely described. FIG. 2 is a cross-sectional view of the film coating apparatus 10, taken along line F2-F2 in FIG. 1. FIG. 2 shows a state in which the film coating apparatus 10 is vertically cut along the convey direction A.

Figure 2:
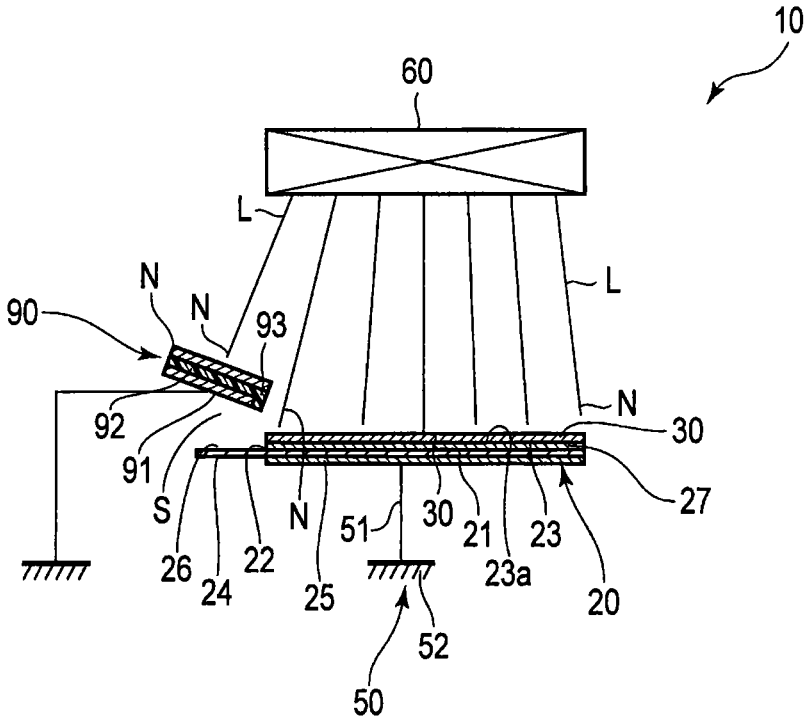
FIG. 2 is a cross-sectional view of the film coating apparatus, taken along line F2-F2 in FIG. 1.

As illustrated in FIG. 2, the electrode 20 includes a current collector sheet 21 which is formed of, for example, a material consisting mainly of aluminum, a first active material layer 23 provided on a first major surface 22 of the current collector sheet 21, and a second active material layer 25 provided on a second major surface 24 of the current collector sheet 21. The active material layer 23, 25 is formed such that an active material and a conductive agent are fixed on the current collector sheet 21 by a binder.

A non-coating portion 26, on which no nanofiber is coated, is set on the first major surface 22 of the current collector sheet 21. In other words, the non-coating portion 26 is a range in which the separator 30 is not formed.

The non-coating portion 26 is set at one end portion of the first major surface 22. The active material layer 23 is stacked on that part of the first major surface 22, which excludes the non-coating portion 26. In the present embodiment, for example, a surface 23*a* of the first active material layer 23 is a coating portion 27 on which nanofibers N are coated to form the separator 30.

The mask 90 is disposed above the non-coating portion 26. The mask 90 is not in contact with the electrode 20, and a spacing S is provided between the mask 90 and the electrode 20. The mask 90 is disposed at a position overlapping the non-coating portion 26 along a trajectory of nanofibers N discharged from the discharge device 60 toward the non-coating portion 26, or in other words, along a direction of travel from the discharge device 60 toward the non-coating portion 26.

To be more specific, the mask 90 is disposed at such a position that the nanofibers N, which fly so as to be coated on the non-coating portion 26, are blocked by the mask 90, and thereby the nanofibers N are deposited not on the non-coating portion 26 but on the mask 90.

The mask 90 has such a length as to cover the entirety of the non-coating portion 26 along the convey direction A. The mask 90 includes a metal portion 91, and a resin portion 92 stacked on the metal portion 91. The resin portion 92 includes a cover portion 93 which covers the electrode 20 side of the metal portion 91. Thus, as illustrated in FIG. 2, the cross-sectional shape of the resin portion 92 is an L shape.

As illustrated in FIG. 1, the mask grounding module 100 includes a wiring line 101 which is connected to the metal portion 91, and a base portion 102. The wiring line 101 is connected to the base portion 102, and a part of the base portion 102 is, for example, buried in the earth. The base portion 102 is configured to be able to keep the potential of the mask 90 at zero.

The control device 110 is configured to be able to control the operations of the convey device 40, discharge device 60 and voltage application device 80.

Next, the operation of the film coating apparatus 10 is described. The electrode 20 is disposed on the convey device 40 in a predetermined disposition state. Specifically, the electrode 20 is fixed to the take-up roller 42 and driven roller 45 in a state in which the longitudinal direction of the electrode 20 agrees with the convey direction A. Incidentally, the electrode 20, on which no film is formed, is wound around the driven roller 45 in a plurality of layers.

The worker, for example, presses a start switch for starting the operation of the film coating apparatus 10, and thus the operation of the film coating apparatus 10 is started. If the operation is started, the operations of the above-described respective devices start.

By the start of the operation of the roller driving device 43, the take-up roller 42 rotates. If the take-up roller 42 rotates, the electrode 20 is taken up, and the electrode 20 is pulled, and thereby the electrode 20, which is wound around the driven roller 45, is fed out. Thus, the electrode 20 is conveyed in the convey direction A.

By the start of the operations of the liquid supply device 70 and power supply device 82, the liquid L for forming nanofibers N is supplied to the discharge device 60. The liquid L, which has been supplied to the discharge device 60, is discharged after a voltage is applied to the liquid L.

The liquid L, which has been discharged from the discharge device 60, forms nanofibers N during the time before the liquid L reaches the electrode 20. Part of the nanofibers N fall on the surface 23*a* of the first active material layer 23 that is the coating portion 27. The nanofibers N falling on the surface 23*a* form the separator 30 in the shape of a nonwoven fabric.

The other of the nanofibers N deposit on the resin portion 92 of the mask 90. Since the mask 90 is disposed above the non-coating portion 26, no nanofiber N deposits on the non-coating portion 26.

Since the mask 90 is disposed on the mask grounding module 100, even if charged nanofibers N deposit on the mask 90, the potential of the mask 90 is kept at zero. In short, the potential of the mask 90 is kept equal to the potential of the electrode 20.

In addition, since the resin portion 92 of the mask 90 includes the cover portion 93 which covers that side part of the metal portion 91, which is located on the electrode 20 side, that edge of the metal portion 91, which is located on the electrode 20 side, is not exposed, and therefore the nanofibers N are prevented from being attracted to this edge. As a result, it is possible to prevent the nanofibers N from reaching the lower side of the mask 90.

In the film coating apparatus 10 with the above-described structure, the potential of the mask 90 is prevented from rising, and thereby the potential of the mask 90 can be made equal to the potential of the electrode 20. Therefore, a Coulomb force is prevented from occurring between the non-coating portion 26 of the electrode 20 and the mask 90.

Since no Coulomb force occurs between the non-coating portion 26 of the electrode 20 and the mask 90, the electrode 20 is not attracted to the mask 90 by the Coulomb force. Thus, it is possible to prevent the electrode 20 from being deformed by being attracted to the mask 90. In addition, since the deformation of the electrode 20 is prevented and the electrode 20 does not come in contact with the mask 90, damage to the electrode 20 due to the contact can be prevented.

Furthermore, the electrode grounding module 50 and mask grounding module 100 are used as an example of the potential adjusting module which equalizes the potential of the mask 90 and the potential of the electrode 20. Since these grounding modules 50 and 100 have simple structures including the connection lines 51 and 101 and base portions 52 and 102, the potential adjusting module can be simply constructed.

Besides, that edge of the metal portion 91 of the mask 90, which is located on the electrode 20 side, is covered with the cover portion 93 of the resin portion 92. Thereby, since the nanofibers are prevented from reaching the lower side of the mask 90, the nanofibers N are prevented from being coated on the non-coating portion 26.

Incidentally, in the present embodiment, the potential of the mask 90 is kept at zero by the mask grounding module 100, that is, the potential of the mask 90 is prevented from rising. Thereby, the potential of the mask 90 is made equal to the potential of the electrode 20.

In another example, even when the potential of the mask 90 becomes slightly higher relative to the electrode 20, if a Coulomb force occurring between the electrode 20 and the mask 90 is such a Coulomb force as not to deform the electrode 20, the mask grounding module 100 may tolerate such an increase of the voltage of the mask 90.

For example, in the embodiment, the electrode is wound around the roller 42, 45, and thereby a tensile force acts on the electrode. Since the electrode 20 is in a state in which the electrode 20 is pulled by this tensile force, the electrode 20 does not deform if a Coulomb force is little.

In this manner, in this embodiment, by making equal the potentials of the mask 90 and electrode 20, the damage to the non-coating portion can be prevented and the selective coating on the film formation object can be performed. In addition, even when the potential of the mask 90 becomes higher relative to the electrode 20, if the potential difference is such a degree as not to deform the electrode 20, that is, if an increase in potential of the mask 90 can be suppressed to such as degree as not to deform the electrode 20, for example, by the potential increase prevention module that is the mask grounding module 100, the damage to the non-coating portion can be prevented and the selective coating on the film formation object can be performed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A film coating apparatus comprising:

a discharge section configured to discharge a film formation material;

a voltage application section configured to apply a voltage to the film formation material, and to set the film formation material at a high potential relative to a film formation object which is subjected to film formation;

a mask disposed at a position overlapping a non-coating portion of the film formation object along a direction from the discharge section toward the non-coating portion; and a potential adjusting module configured to make a potential of the mask equal to a potential of the film formation object, wherein the potential adjusting module includes a film formation object grounding module configured to ground the film formation object, and a mask grounding module configured to ground the mask, the mask includes a metal portion and a resin portion provided on the metal portion, the metal portion is grounded, and the resin portion includes a cover portion configured to cover an edge of the metal portion on the non-coating portion side, and the metal portion is not in contact with the film formation object, and a spacing is provided between the metal portion and the non-coating portion.

2. A film coating apparatus comprising:

a discharge section configured to discharge a film formation material;

a voltage application section configured to apply a voltage to the film formation material, and to set the film formation material at a high potential relative to a film formation object which is subjected to film formation;

a mask disposed at a position overlapping a non-coating portion of the film formation object along a direction from the discharge section toward the non-coating portion; and a potential increase prevention module configured to prevent an increase in potential of the mask, wherein the potential increase prevention module is a mask grounding module configured to ground the mask, the mask includes a metal portion and a resin portion provided on the metal portion, the metal portion is grounded, and the resin portion includes a cover portion configured to cover an edge of the metal portion on the non-coating portion side, and the metal portion is not in contact with the film formation object, and a spacing is provided between the metal portion and the non-coating portion.

* * * * *